US006719099B2

(12) United States Patent
Lamb et al.

(10) Patent No.: US 6,719,099 B2
(45) Date of Patent: Apr. 13, 2004

(54) INTEGRAL ELEVATOR HYDRAULIC POWER UNIT

(75) Inventors: Miles P. Lamb, Chester, NJ (US); William J. Rafferty, Oak Ridge, NJ (US)

(73) Assignee: Inventio AG, Hergiswil (CH)

( * ) Notice: Subject to any disclaimer, the term of this patent is extended or adjusted under 35 U.S.C. 154(b) by 156 days.

(21) Appl. No.: 10/144,620

(22) Filed: May 13, 2002

(65) Prior Publication Data

US 2003/0209390 A1 Nov. 13, 2003

(51) Int. Cl.[7] ..... B66B 9/04

(52) U.S. Cl. ..... 187/274; 187/272; 187/275; 187/414; 269/15

(58) Field of Search ..... 187/250, 252, 187/272, 274, 275, 414, 205, 215; 254/89 H, 93 R, 93 H; 269/15, 30

(56) References Cited

U.S. PATENT DOCUMENTS

| | | | | | |
|---|---|---|---|---|---|
| 2,381,664 A | * | 8/1945 | Hansen | ..... | 187/274 |
| 3,279,562 A | * | 10/1966 | Farrell | ..... | 187/215 |
| 3,613,834 A | * | 10/1971 | Field | ..... | 187/274 |
| 4,155,425 A | * | 5/1979 | Allen et al. | ..... | 187/274 |
| 4,667,932 A | | 5/1987 | Arbeloa | | |
| 4,807,890 A | * | 2/1989 | Gorman et al. | ..... | 187/274 |
| 5,339,925 A | * | 8/1994 | Price | ..... | 187/215 |
| 5,573,083 A | * | 11/1996 | Fletcher et al. | ..... | 187/205 |
| 5,597,987 A | * | 1/1997 | Gilliland et al. | ..... | 187/274 |

FOREIGN PATENT DOCUMENTS

| | | | | |
|---|---|---|---|---|
| EP | 0 924 155 A3 | | 6/1999 | |
| SE | 332 698 | | 11/1971 | |
| SU | 569467 | * | 8/1977 | ..... 269/15 |

* cited by examiner

*Primary Examiner*—Eileen D. Lillis
*Assistant Examiner*—Thuy V. Tran
(74) *Attorney, Agent, or Firm*—Schweitzer Cornman Gross & Bondell LLP

(57) ABSTRACT

A hydraulic power unit for use in conjunction with an elevator construction having an elevator car operably connected to a pair of hydraulic rams comprises a chassis having a floor and a sidewall forming a hydraulic fluid sump region. The hydraulic rams are mounted to the floor in the sump region. A hydraulic fluid reservoir is supported by the chassis, which also supports a pump/motor unit for the rams. Leveling feet mounted to the chassis allow the power unit to accommodate a variety of conditions in the hoistway pit.

5 Claims, 2 Drawing Sheets

INTEGRAL ELEVATOR HYDRAULIC POWER UNIT

The present invention relates to a new and improved integral hydraulic power unit to be used in connection with elevator constructions.

BACKGROUND OF THE INVENTION

A conventional type of elevator utilizes a hydraulic system having one or more hydraulic rams which raises and lowers the elevator car. The rams are extended by pumping hydraulic fluid into the ram cylinders, while lowering the car is performed by allowing fluid to vent from the cylinders, typically solely due to the compressive load on the ram by the weight of the elevator car. Conventional technology locates the reservoir for the hydraulic fluid, as well as a pump and pump motor, in a machine room adjacent the elevator hoistway. Use of a separate machine room requires additional building space beyond that for the elevator hoistway, and requires associated connections between the apparatus located therein and the hydraulic cylinders located in the hoistway. While locating the hydraulic equipment in a separate machine room provides a degree of design flexibility, it adds to the overall cost of the construction, and utilizes expensive space which often can be put to more productive use.

It is accordingly a purpose of the present invention to provide a hydraulic power unit that is integrated with the elevator lift and is located within the elevator hoistway.

A further purpose of the present invention is to provide a hydraulic power unit having a reservoir which may be sized and located to support the hydraulic jacks for a twin-jack hydraulic installation.

Still a further purpose of the present invention is to provide an integral hydraulic power unit which may be installed in a hoistway pit, and which can accommodate a variety of pit conditions.

BRIEF DESCRIPTIONS OF THE INVENTION

In accordance with the foregoing and other objects and purposes, an integral elevator hydraulic power unit constructed in accordance with the present invention comprises a chassis which is adapted to be mounted and installed upon the floor of the elevator hoistway. The chassis supports the elevator lift ram means, and is constructed with an integral hydraulic fluid drip pan to serve as a sump for hydraulic fluid which may leak from the ram means. A hydraulic drive, including both a fluid reservoir and a pump/motor unit, are mounted to the chassis and are operatively connected to the ram means to control the passage of hydraulic fluid to and from the ram means to effect elevator travel.

A fuller understanding of the present invention will be accomplished upon consideration of the following detailed description of a preferred, but nonetheless illustrative embodiment of the invention, when reviewed in connection with the annexed figures, wherein.

DETAILED DESCRIPTION OF THE INVENTION

Figure 1:
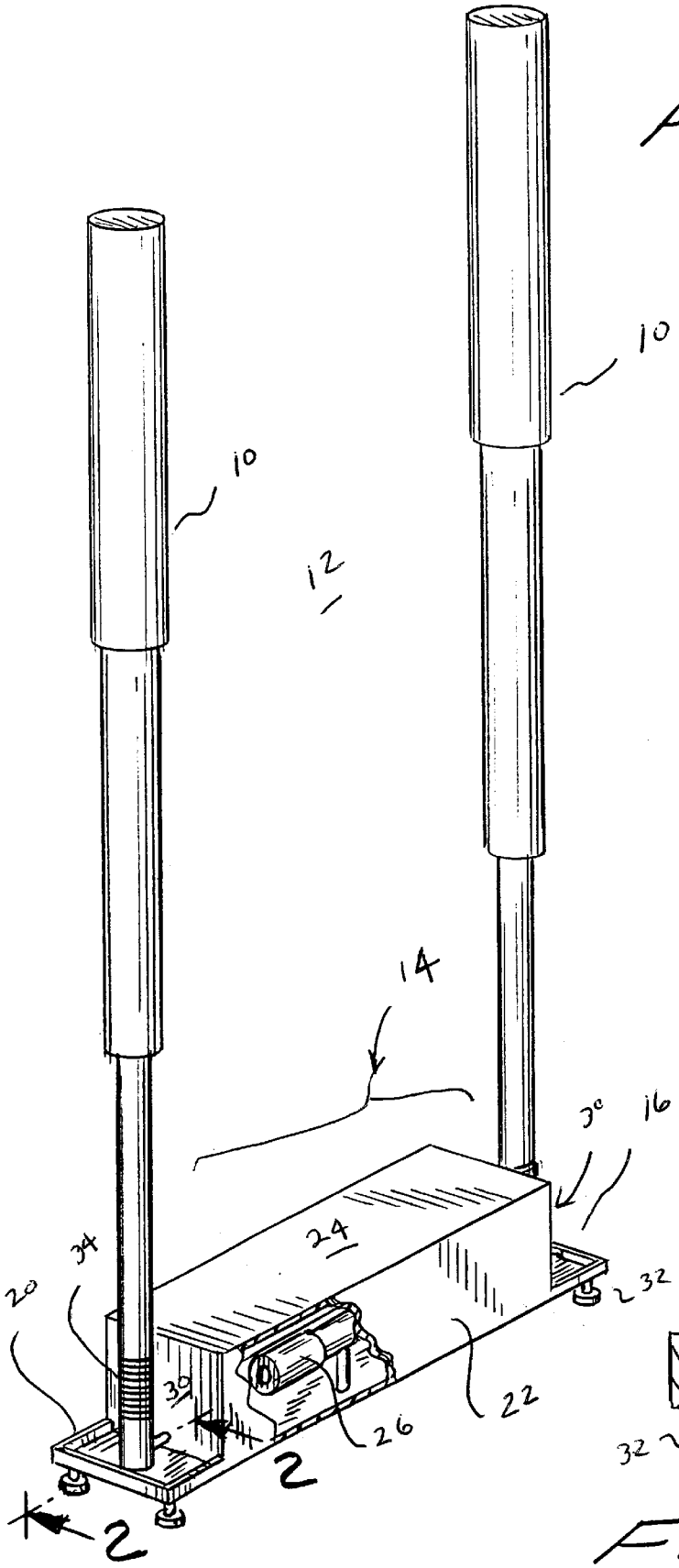
FIG. 1 is a perspective view of the invention.
Figure 2:
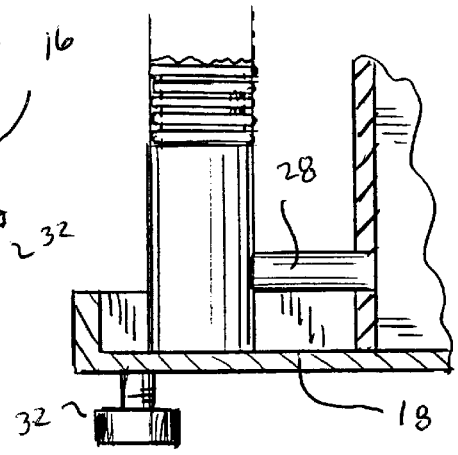
FIG. 2 is a partial section view thereof taken along line 2—2 of FIG. 1.

With reference to the Figures, a hydraulically driven elevator system may include a pair of telescoping hydraulic rams 10 located in the bottom or "pit" area of an elevator hoistway 12, which is the vertical shaft in which the elevator car operates. The upper ends of the rams are connected either directly or indirectly to the elevator car, as known in the art. In accordance with the present invention, the rams 10 are mounted to and supported by the integral hydraulic power unit of the invention, having a frame or chassis 14, which is mounted upon the floor of the hoistway. The chassis 14 includes a rigid baseplate 16 upon which the rams 10 are mounted, the baseplate 16 being surrounded by an upstanding sidewall 18, thereby forming an integral sump or catch basin surrounding the rams for any hydraulic fluid that may leak or otherwise be displaced from the rams.

Further supported by the baseplate 16 is hydraulic drive unit 20. Preferably the drive unit is located between the rams, occupying space which would otherwise be unused. The drive unit includes housing 22, which may be formed integral with the chassis, which encloses and protects the drive unit's pump/motor assembly 24 and the associated electrical connections and hydraulic fittings. The housing 22 may be in the form of a sealed chamber, so that it may serve as a reservoir for the power unit's hydraulic fluid, the pump/motor assembly being of an open construction and being submerged in the hydraulic fluid which then also serves as a coolant and lubricant for the pump/motor assembly. The pump/motor assembly 24 is connected to the hydraulic rams 10 by appropriate piping 26. Alternatively, the housing 22 may enclose a secondary hydraulic tank to which the pump/motor assembly is connected. The sidewalls of the housing 22 extend between the sidewalls 16, forming with the sidewalls a pair of sumps on opposite sides of the housing, each one of the sumps surrounding one of the rams 10.

As hoistway pits often are of an uneven or unfinished floor construction, the hydraulic power unit of the invention is provided with a series of leveling units 30, extending downwardly from the chassis. As shown, the height of each of the leveling units 30 may be individually adjustable, which allows the chassis to be installed in a level and stable orientation upon an uneven pit floor.

Figure 3:
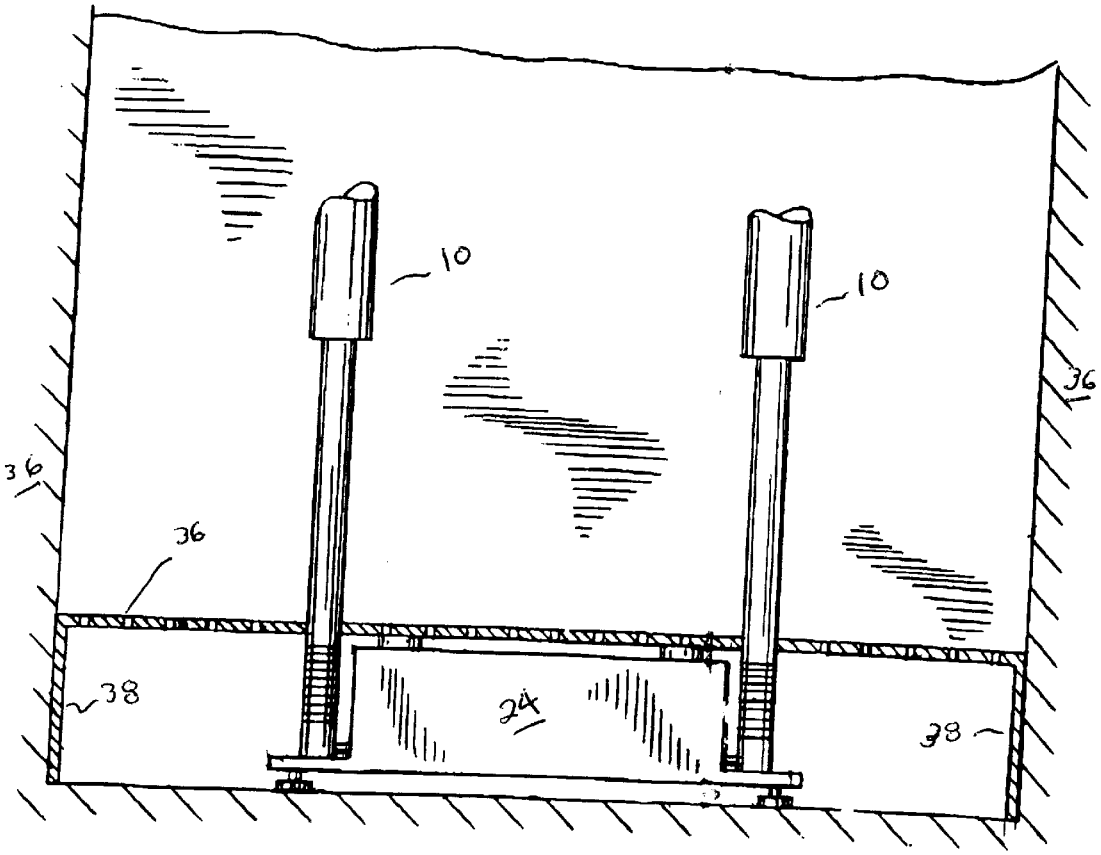
FIG. 3 is end elevation view of the invention within an elevator hoistway pit.

Because the chassis supports the rams 10 as well as the mass of the ram-supported elevator car, the rams may be provided with shock absorption springs 32. The springs buffer transitory shocks and jolts that may occur during ram operation, and prevent such shocks from being passed to the chassis. To allow maintenance personnel to service the elevator and to afford increased safety to workmen in the hoistway, an upper flooring 34 as shown in FIG. 3 may be mounted to the top of the housing 22. The flooring 34 extends substantially between the hoistway pit walls 36, providing a rigid footing surface across the pit area. The flooring may be provided with peripherals supports or legs 36. The upper flooring may preferably be formed of an open mesh metal construction, which allows hydraulic fluid expelled by the rams to pass through the flooring to be collected by the sumps 16. The flooring may be provided with a hatch to allow controlled access to the sump areas below the floor as well as to the housing 22, which itself may be provided with access means into its interior as appropriate.

We claim:

1. A hydraulic power unit for use in a hoistway pit in conjunction with an elevator construction having an elevator car operably connected to a pair of hydraulic rams extending downwardly from the car into the hoistway pit, comprising a chassis having a floor and a sidewall, said floor and sidewall forming a hydraulic fluid sump region, the rams being mounted to said floor in the sump region; a hydraulic fluid reservoir supported by said chassis; a pump/motor unit operably connected to the rams and mounted upon said chassis; and leveling feet mounted to the chassis.

2. The hydraulic power unit of claim 1 wherein the hydraulic fluid reservoir is located between first and second sump regions, each of the sump regions supporting one of the rams.

3. The hydraulic power unit of claim 2 wherein the reservoir is in the form of a closed housing, the pump/motor unit being located within the reservoir.

4. The hydraulic power unit of claim 3 further comprising a raised floor mounted to the closed housing and extending substantially between walls of the hoistway pit.

5. The hydraulic power unit of claim 4 wherein the raised floor is of an open mesh construction.

* * * * *